US010591114B1

(12) United States Patent
Lassen et al.

(10) Patent No.: US 10,591,114 B1
(45) Date of Patent: Mar. 17, 2020

(54) CONNECTORS FOR LINEAR LIGHTING

(71) Applicant: Elemental LED, Inc., Reno, NV (US)

(72) Inventors: Andrew Lassen, Reno, NV (US); Olivia M. Tanguileg, Reno, NV (US); William Schimandle, Stagecoach, NV (US)

(73) Assignee: Elemental LED, Inc., Reno, NV (US)

( * ) Notice: Subject to any disclaimer, the term of this patent is extended or adjusted under 35 U.S.C. 154(b) by 0 days.

(21) Appl. No.: 16/575,866

(22) Filed: Sep. 19, 2019

(51) Int. Cl.

| | |
|---|---|
| ***F21V 23/00*** | (2015.01) |
| ***F21K 9/20*** | (2016.01) |
| ***F21V 15/01*** | (2006.01) |
| *F21S 4/20* | (2016.01) |
| *H01R 25/14* | (2006.01) |
| *H01R 4/36* | (2006.01) |
| *H01R 4/46* | (2006.01) |
| *H01R 9/24* | (2006.01) |

(52) U.S. Cl.
CPC ..... *F21K 9/20* (2016.08); *F21V 15/013* (2013.01); *F21V 23/003* (2013.01); *F21S 4/20* (2016.01); *H01R 4/363* (2013.01); *H01R 4/46* (2013.01); *H01R 9/24* (2013.01); *H01R 25/145* (2013.01)

(58) Field of Classification Search
CPC . H01R 4/363; H01R 4/46; H01R 9/24; H01R 25/145
See application file for complete search history.

(56) References Cited

U.S. PATENT DOCUMENTS

| | | | | | |
|---|---|---|---|---|---|
| 264,299 | A | * | 12/1882 | Johnson | H01R 4/363 |
| 3,629,806 | A | * | 12/1971 | Wiechmann | H01R 4/363 439/521 |
| 3,670,290 | A | | 6/1972 | Angele et al. | |
| 4,768,969 | A | | 9/1988 | Bauer et al. | |
| 4,952,177 | A | | 8/1990 | Drake et al. | |
| 5,336,100 | A | * | 8/1994 | Gabrius | H01R 25/14 439/115 |
| 5,848,837 | A | | 12/1998 | Gustafson | |
| 6,093,037 | A | * | 7/2000 | Lin | H01R 25/162 439/115 |

(Continued)

FOREIGN PATENT DOCUMENTS

| | | | | |
|---|---|---|---|---|
| DE | 1018495 B1 | * | 10/1957 | H01R 4/363 |
| EP | 1852941 A1 | * | 11/2007 | H01R 4/363 |

(Continued)

*Primary Examiner* — Tho D Ta
(74) *Attorney, Agent, or Firm* — United IP Counselors, LLC

(57) ABSTRACT

Connectors for linear lighting are disclosed. These connectors include one side with a slot adapted to accept a strip of linear lighting. The other side may have either another slot for a second strip of linear lighting, if two strips of linear lighting are to be electrically connected end-to-end, or a set of terminal blocks for connecting the strip of linear lighting to wires, such as a set of power leads. The slot has a set of contacts, spaced from one another, that make physical contact with solder pads or other such electrical connecting structures on the linear lighting. The terminal blocks have conductive cages to make contact with the wires. Both the set of contacts in the slot and pressor members in the cages are driven into engagement by sets of adjustable positioning members that bear on them.

14 Claims, 5 Drawing Sheets

(56) References Cited

U.S. PATENT DOCUMENTS

| | | | | |
|---|---|---|---|---|
| 6,273,587 | B1 * | 8/2001 | Demshki | F21V 27/02 362/219 |
| 6,283,612 | B1 | 9/2001 | Hunter | |
| 6,358,070 | B1 * | 3/2002 | Lin | H01R 25/145 439/115 |
| 6,802,748 | B2 | 10/2004 | Wertz et al. | |
| 7,175,303 | B2 | 2/2007 | Kovacik et al. | |
| 7,473,006 | B1 | 1/2009 | Bollman | |
| 8,231,261 | B2 | 7/2012 | Gherardini et al. | |
| 8,297,788 | B2 | 10/2012 | Bishop | |
| 8,454,193 | B2 | 8/2013 | Simon et al. | |
| 8,714,772 | B1 | 5/2014 | Levante et al. | |
| 8,979,296 | B2 | 3/2015 | Wiemer et al. | |
| 9,206,964 | B2 | 12/2015 | Marsh et al. | |
| 9,239,136 | B1 | 1/2016 | Petersen et al. | |
| 9,374,856 | B2 | 6/2016 | Winton | |
| 2002/0004336 | A1 | 1/2002 | Yamaguchi | |
| 2002/0106931 | A1 | 8/2002 | Hsien-Te | |
| 2004/0115984 | A1 | 6/2004 | Rudy et al. | |
| 2005/0174808 | A1 | 8/2005 | Butsch et al. | |
| 2005/0215108 | A1 | 9/2005 | Chen | |
| 2005/0260874 | A1 | 11/2005 | Murakami et al. | |
| 2006/0197474 | A1 | 9/2006 | Olsen | |
| 2009/0064571 | A1 | 3/2009 | Fakhari | |
| 2010/0008090 | A1 | 1/2010 | Li et al. | |
| 2012/0002417 | A1 | 1/2012 | Li | |
| 2012/0075863 | A1 | 3/2012 | Chen | |
| 2013/0249394 | A1 | 9/2013 | Fay | |
| 2015/0077998 | A1 | 3/2015 | Zhang | |
| 2015/0117005 | A1 | 4/2015 | Zanotto et al. | |
| 2015/0285472 | A1 | 10/2015 | Evitt | |

FOREIGN PATENT DOCUMENTS

| | | | | |
|---|---|---|---|---|
| EP | 2075875 | * | 7/2009 | H01R 4/363 |
| EP | 2078895 | B1 | 12/2012 | |
| WO | 2013010445 | A1 | 1/2013 | |

* cited by examiner

CONNECTORS FOR LINEAR LIGHTING

TECHNICAL FIELD

The invention relates to connectors for linear lighting.

BACKGROUND

Linear lighting is a particular class of solid-state lighting, the general term for lighting that uses light-emitting diodes (LEDs) as a light source. Typically, linear lighting is comprised of a thin, elongate printed circuit board (PCB) on which are disposed a number of LED light engines, typically spaced at a regular pitch along the PCB. The PCB may be either rigid or flexible, and includes the conductors and other circuit elements necessary to power and control the LED light engines. By connecting shorter strips of linear lighting during the manufacturing process, a finished strip of linear lighting may have essentially any length. Spools of flexible linear lighting 100 feet (30 meters) long are common, and 400-foot (122 meter) spools of flexible linear lighting are commercially available.

The circuits on the PCB of a strip of linear lighting are usually physically and electrically arranged in repeating blocks, so that the PCB can be cut at defined cut points between adjacent repeating blocks. In some cases, linear lighting is cut to a desired length and connected to power during finishing steps in the factory. In other cases, linear lighting may be cut to length in the field by an electrician or other individual who is installing it in a particular location.

Each repeating block of the PCB of a strip of linear lighting usually includes electrical contacts for connecting to power. Connections between the PCB and power are typically made by soldering wires to the PCB. However, soldering is a process that requires skill and practice; poorly done, soldering may damage the PCB or render the PCB more susceptible to damage as the linear lighting ages.

There are connectors on the market that allow for solderless connection between a strip of linear lighting and power leads, and also between two strips of linear lighting. U.S. Pat. No. 9,239,136, the contents of which are incorporated by reference in their entirety, discloses one such set of connectors. With connectors of this type, it can be difficult to maintain a positive connection to the PCB.

SUMMARY OF THE INVENTION

Aspects of the invention relate to connectors for linear lighting. These connectors include one side with a slot adapted to accept a strip of linear lighting. The other side may have either another slot for a second strip of linear lighting, if two strips of linear lighting are to be electrically connected end-to-end, or a set of terminal blocks for connecting the strip of linear lighting to wires, such as a set of power leads. The slot has a set of contacts, spaced from one another, that make physical contact with solder pads or other such electrical connecting structures on the linear lighting. The slot may also have an inwardly-extending notch in its upper surface so that light from an LED light engine that is in or near the slot will be released. The terminal blocks have conductive cages to make contact with the wires. The cages have pressor members in them. Both the set of contacts in the slot and the pressor members in the cages are driven down into positive engagement with the respective structures they contact by sets of adjustable positioning members, such as screws, that bear on them.

Other aspects, features, and advantages of the invention will be set forth in the description that follows.

BRIEF DESCRIPTION OF THE DRAWING FIGURES

DETAILED DESCRIPTION

Figure 1:
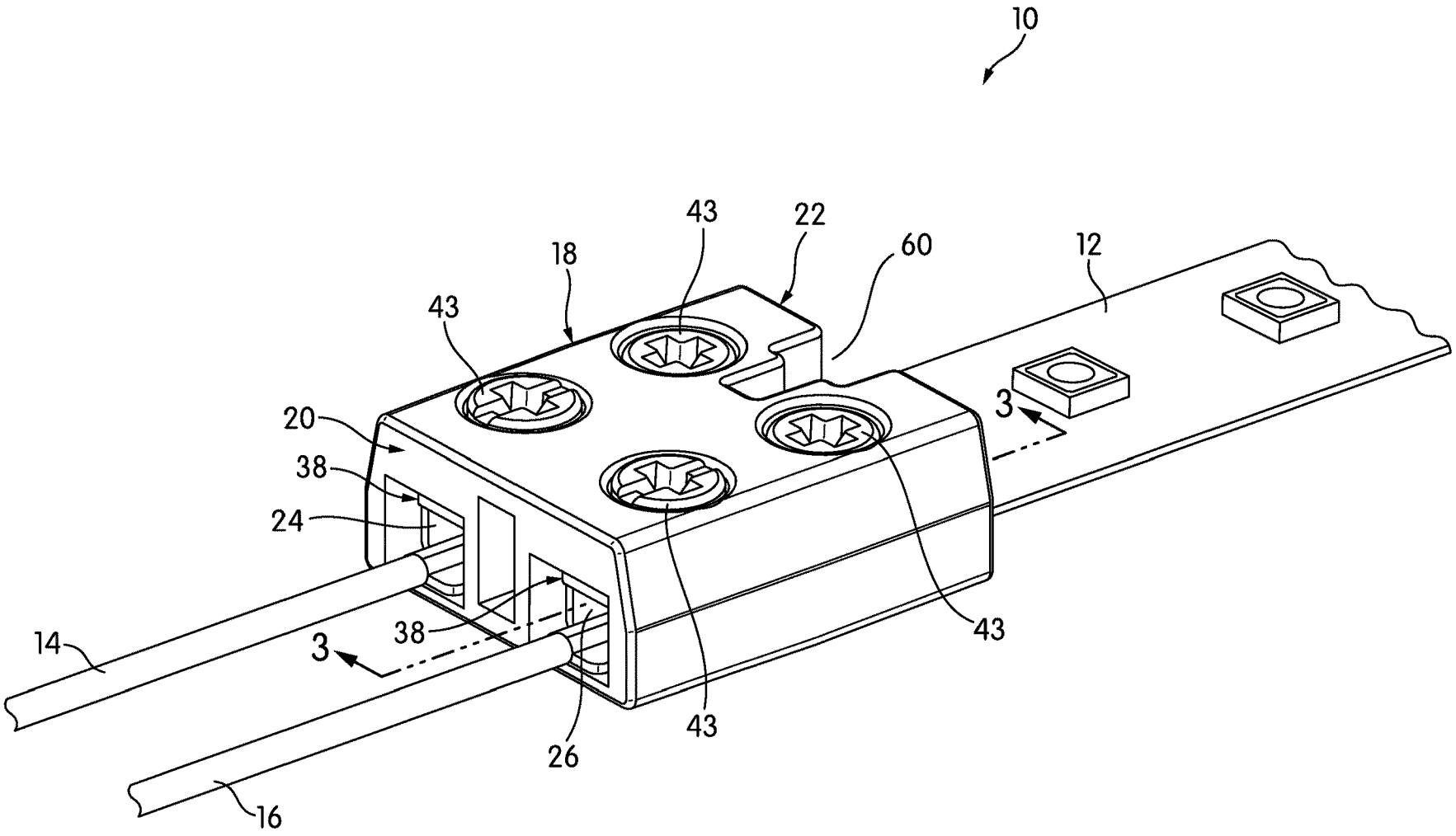
FIG. 1 is a perspective view of a connector for linear lighting according to one embodiment of the invention.

FIG. 1 is a perspective view of a connector, generally indicated at 10, according to one embodiment of the invention. The connector 10 of FIG. 1 connects between a strip of linear lighting 12 and a set of power leads 14, 16. Specifically, the connector 10 has a body 18. On one side, the body 18 provides a terminal block 20 for the set of power leads 14, 16; on the other side, the body 18 provides a slot 22 for the strip of linear lighting 12.

This description will generally assume that the linear lighting 12 is a two-wire, low-voltage system. Therefore, the terminal block 20 provides two terminals 24, 26, one for each of the two power leads 14, 16. However, the terminal block 20 need not convey only power; rather, it may also be used to convey control signals or any other type of signal required by the linear lighting 12. In other embodiments, for example, if the linear lighting is RGB linear lighting, dim-to-warm, or has some other features that require additional signals for power or control, the terminal block 20 could provide additional terminals for wires to convey those signals. Alternatively, the terminal block 20 could link to another terminal block 20 or to another strip of linear lighting 12 with any length of wire in between.

With respect to voltage, while the meaning of the term "low voltage" varies according to the authority one consults, for purposes of this description, that term should be construed to refer to voltages under about 50V. While the connector 10, and other connectors according to embodiments of the invention, may be used with high-voltage linear lighting, electrical and safety regulations in various jurisdictions may impose additional requirements on the linear lighting and on the connector.

The set of power leads 14, 16 are typically braided wires, although they may be solid conductors in some embodiments. In most embodiments, they will be between 14-22 American Wire Gauge (AWG), although thinner and thicker wires may be used. Consequently, the terminals 24, 26 may be sized and otherwise adapted for either that entire range of wire gauges, or a subset of it. For example, a particular terminal block 20 may be adapted to accept wires between 18-22 AWG.

Figure 2:
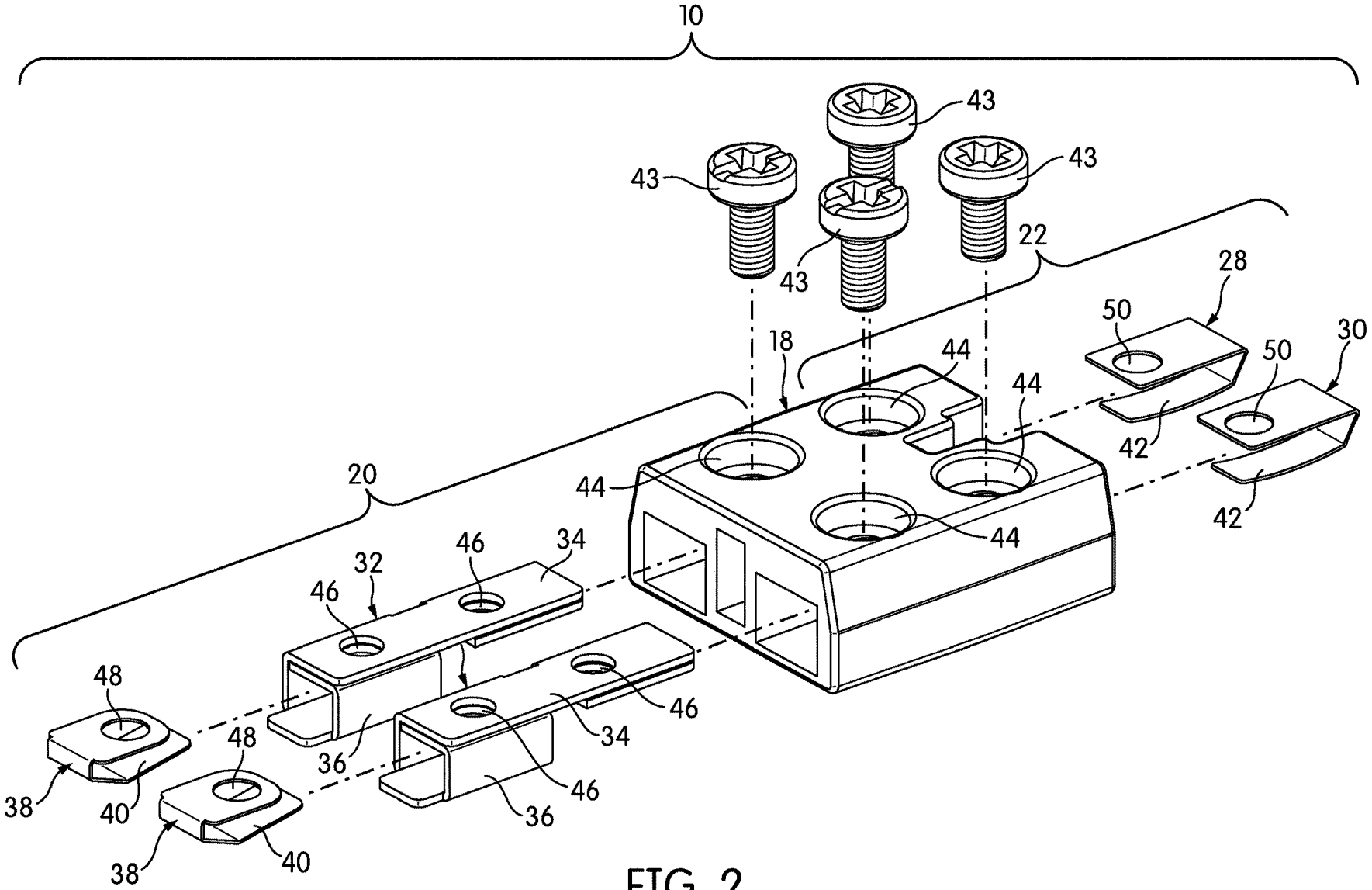
FIG. 2 is an exploded perspective view of the connector of FIG. 1.

FIG. 2 is an exploded perspective view of the connector 10 of FIG. 1. As can be seen in FIGS. 1 and 2, the body 18 of the connector 10 houses a number of components that make electrical contact between the terminals 24, 26 of the terminal block 20 and contacts 28, 30 within the slot 22 that connect to the linear lighting 12. The body 18 itself is usually made of a nonconductive material, such as a plastic, although it may be made of a metal or another such conductive material if its interior is sufficiently electrically insulated so as not to cause an electrical short. In the illustrated embodiment, the body 18 is made of a transparent plastic, which may provide for better visualization of whether or not the leads 14, 16 and the strip of linear lighting 12 are properly positioned.

Figure 3:
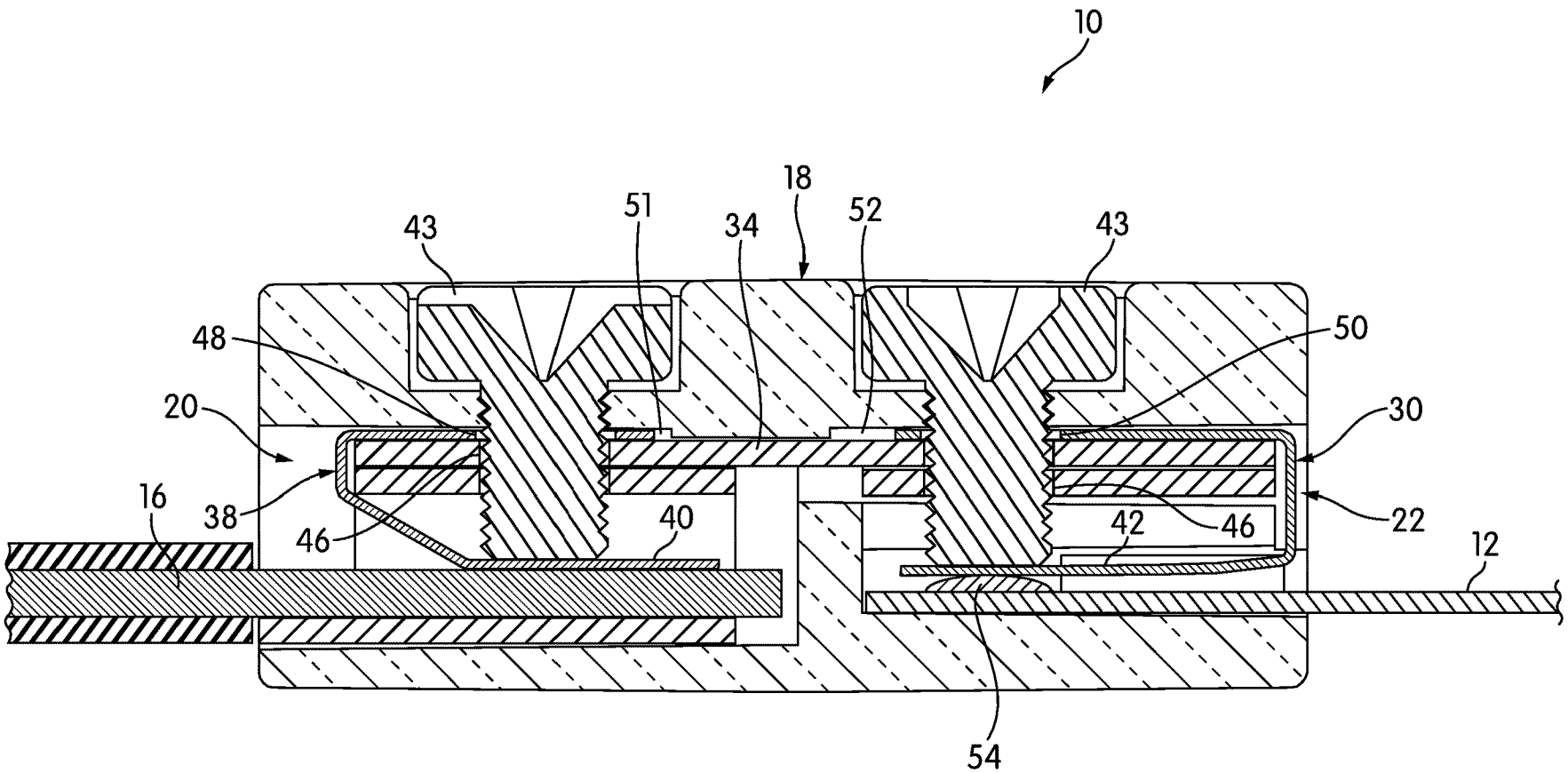
FIG. 3 is a cross-sectional view of the connector, taken through Line 3-3 of FIG. 1.

As shown in FIG. 2 and in FIG. 3, a longitudinal cross-section of the connector 10, each terminal 24, 26 has a terminal member 32. The terminal member 32 is made of a conductive material, such as a metal, and may be folded from sheet metal. At the top of each terminal member 32 is a generally flat connector piece 34. The connector piece 34 extends substantially the entirety of the length of the body 18 of the connector 10 and is the primary member responsible for connecting the terminals 24, 28 with the contacts 28, 30 on the other side of the connector 10.

On the terminal block 20 side, the terminal member 32 is folded down into a four-sided cage 36. A thin, resilient, generally C-shaped, conductive pressor member 38, also made of a metal, fits within the cage 36 and extends downwardly, providing a tongue 40 that presses down resiliently on the power lead 12, 14. On the other side, the contacts 28, 30 are shaped similarly to the pressor members 38: they are thin, generally C-shaped and have lower tongues 42 that can press down resiliently against the contacts of the inserted linear lighting 12. The contacts 28, 30 are also made of metal.

As shown in FIGS. 2 and 3, four screws 43 insert into corresponding threaded holes 44 in the body 18 of the connector 10, extending downwardly through corresponding through-holes 46 in the connector piece 34, as well as through-holes 48, 50 in the contacts 28, 30 and the pressor members 38. As can best be seen in FIG. 3, when the connector 10 is assembled, the screws 43 extend into the connector body 18, through the connector piece 34 and bear on the upper surfaces of the tongues 40, 42, forcing the tongues 40, 42 downward and into contact with the conductors 14, 16 and the linear lighting 12. The screws 43 themselves may all be the same length, or they may be different lengths. As can be seen in the view of FIG. 3, the screw 43 that secures the wire 16 is slightly shorter than the other screw 43, so that the screws 43 all rest at the same level and bear against the connector 10. However, that need not be the case in all embodiments.

The arrangement of the connector 10 means that the screws 43 themselves need not be conductive, although they may be in some embodiments. This is because the screws 43 never make electrical contact with the leads 14, 16 or the strip of linear lighting 12. Rather, they bias the contacts 28, 30 and the pressor members 38 into contact with those elements. Plastic screws 43, or screws 43 made of another nonconductive material, may be used in some embodiments in order to better protect against electrical shorts. Moreover, while the term "screw" is used in this description, any adjustable positioning member that can exert force on the tongues 40, 42 to bias them into contact may be used. In some embodiments, members that can be tightened manually may be used.

As shown in FIG. 3, the tops of the contacts 28, 30 and the pressor members 38 rest in slight recesses 51, 52 in the upper portion of the body 18. The connector pieces 34 of the terminal members 32 insert under the contacts 28, 30 and the pressor members 38, essentially wedging the tops of those components in place.

On the side of the slot 22, the tongues 42 would typically make contact with solder pads 54 formed on the linear lighting 12. Generally speaking, a solder pad 54 is a defined area for solder connections. Most solder pads 54 are locations where conductive traces or material are broadened or exposed to permit electrical connections to be made. Typically, as is the case in FIG. 3, the solder pad 54 is covered with solder, providing a raised surface for contact.

This arrangement has several advantages. First, the leads 14, 16 are caged within the cages 36 of the terminals 24, 26. This provides for all-around electrical contact between the leads 14 and the terminal members 32. Additionally, rather than engaging directly with a screw 43 to establish physical and electrical contact, the screws 43 push on wide, flat tongues 40, 42 that make physical and electrical contact with the elements 12, 14, 16. This may provide for more contact surface area and thus better and more consistent contact.

The body 18 of the connector 10 may be manufactured in any convenient way. In the embodiment of FIGS. 1-3, the connector 10 is made in top and bottom halves, each of which is injection molded. The body 18 is specifically adapted for use with linear lighting 12. Specifically, as shown in FIGS. 1 and 2, the body 18 includes a wide notch 60 aligned with the longitudinal centerline of the body 18. The notch 60 is stepped in width, broader close to the edge of the body 18 and stepping down to a narrower width as it extends into the body 18. When a strip of LED lighting 12 is inserted into a connector 10 such as this, there is the possibility of obscuring the light from the LED light engine that is nearest to the solder pads 54 that are being used for connection. The notch 60 provides space to allow light from the last LED light engine on the strip 12 to escape, preventing both wasted light and dark spots. As will be described in more detail, the walls of the notch 60 may be set so as to allow for maximum beam width for the escaping light.

Figure 4:
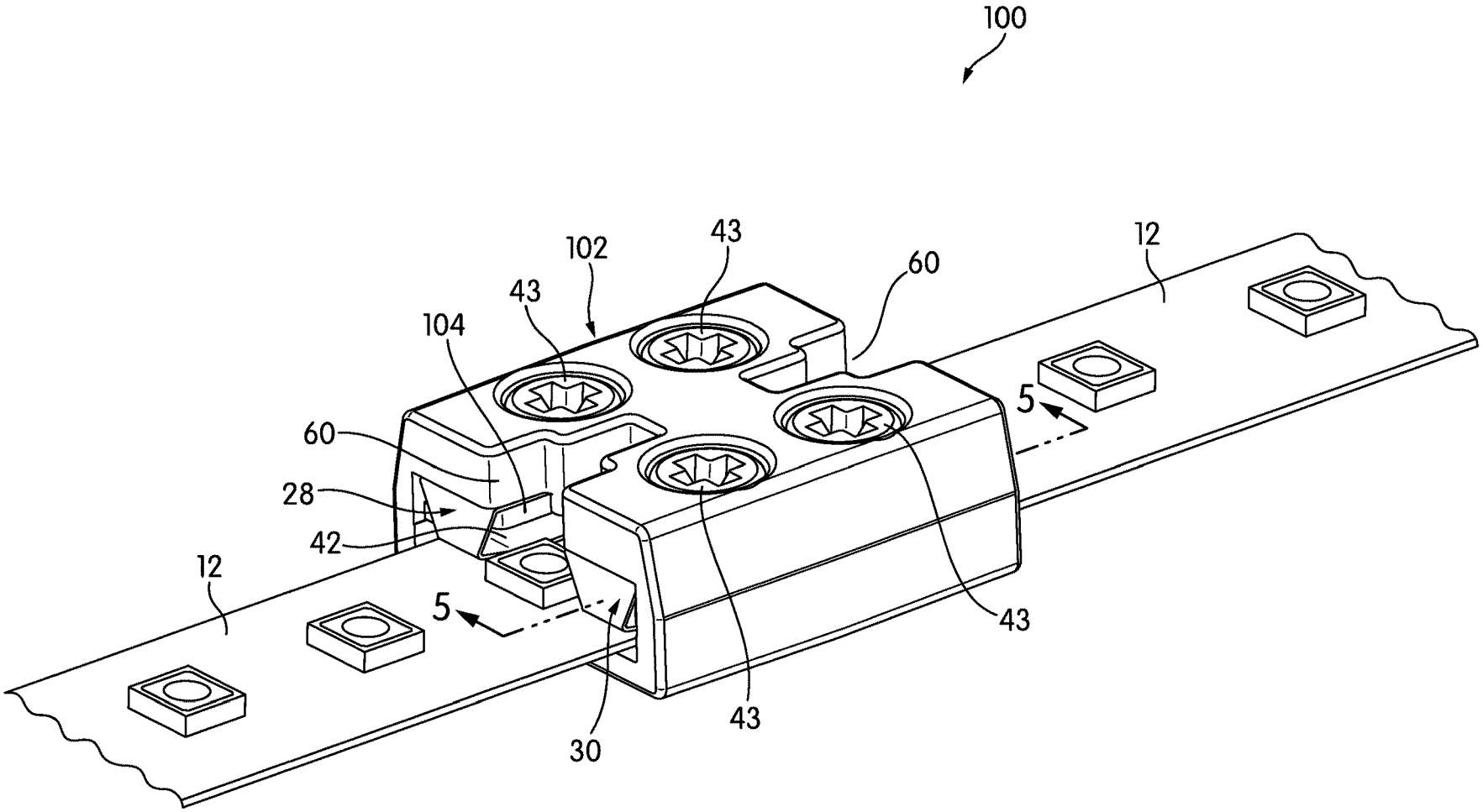
FIG. 4 is a perspective view of a connector for linear lighting according to another embodiment of the invention.

FIG. 4 is a perspective view of a connector, generally indicated at 100, according to another embodiment of the invention. More specifically, whereas the connector 10 of FIGS. 1-3 connects between a pair of power leads 14, 16 and a strip of linear lighting, the connector 100 of FIG. 4 connects between two strips of linear lighting 12. In many ways, the connector 100 includes the features of the linear lighting 12 side of the connector 10, symmetrically duplicated.

More specifically, the body 102 includes two notches 60, one on each side of the connector 100, so that the last LED in each strip 12 is exposed despite the connector 100, as described above. As can be seen in FIG. 4, the contacts 28, 30 are trapezoidal in shape as viewed from the front, with the narrower side facing down and making contact with the linear lighting 10. In other words, the tongues 42 are narrower than the tops of the contacts 28, 30. This may provide more space for an LED light engine in the slot 60, and may also avoid making contact with other structures on the linear lighting 12, which could cause a short.

Figure 5:
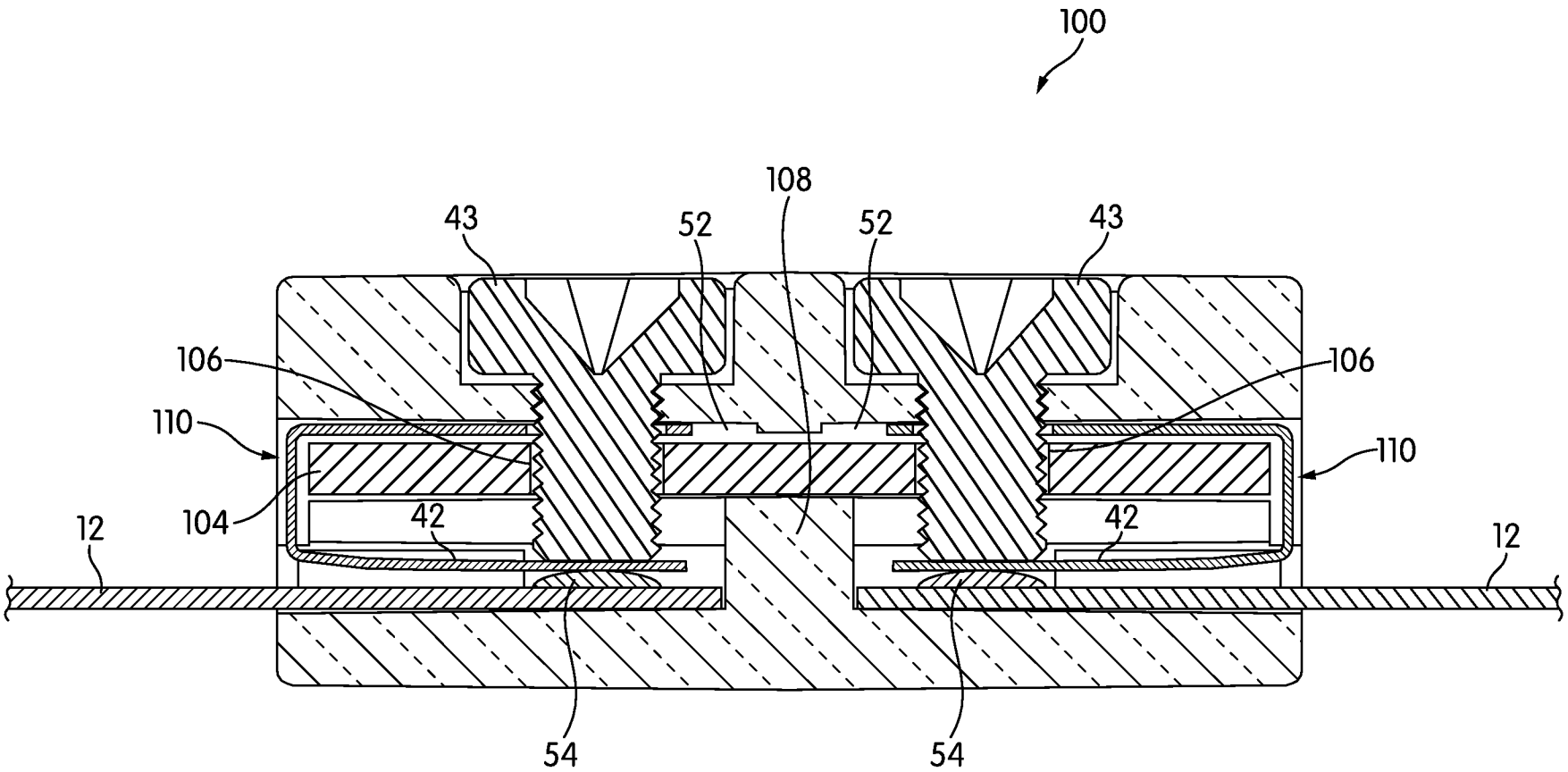
FIG. 5 is a cross-sectional view of the connector of FIG. 4, taken through Line 5-5 of FIG. 4.

FIG. 5 is a cross-sectional view of the connector 100 taken through Line 5-5 of FIG. 4. One primary difference between the connector 10 and the connector 100 is in how the two sides of the body 102 are connected to one another. In the connector 100, there is no connecting member 32 with a connecting piece 34. Instead, a flat, rectilinear connecting piece 104 simply extends straight across the body 102 of the connector in the view of FIG. 5; the connecting piece 104 has holes 106 to allow the screws 43 to pass, and is located just below the upper parts of the contacts 28, 30, which extend within recesses 52 in the upper portion of the body 102. A bar 108 rises up from the interior bottom of the body 102 and extends transversely across the body 102 to support the two connecting pieces 104, one for each of the contacts

28, 30. The bar 108 also forms the barrier between the slots 110 for the two strips of linear lighting 12.

In this description, the term "about" means that variation around the stated value or range is permitted so long as the variation does not change the desired or described outcome. If it cannot be determined what set of values would change the desired or described outcome, the term "about" should be read to mean±5%.

While the invention has been described with respect to certain embodiments, the description is intended to be exemplary, rather than limiting. Modifications and changes may be made within the scope of the invention, which is defined by the appended claims.

What is claimed is:

1. A connector, comprising:

a body, including a first side having a first notch in a top portion of the body, the first notch extending inwardly from an edge thereof, a first slot extending inwardly from the edge, aligned with and below the first notch, and two or more conductive first contact members within the first slot; a conductive member for each of the two or more first contact members, the conductive members making electrical contact with respective ones of the two or more first contact members and extending from the first side to a second side of the body;

the second side receiving the conductive members and being adapted to make an electrical connection with the first side through the conductive members; and an adjustable positioning member for each of the two or more first contacts, the adjustable positioning members extending through the body from a top surface thereof and bearing on the two or more first contact members to force the two or more first contact members downwardly.

2. The connector of claim 1, wherein:

the second side further comprises a terminal block corresponding to each of the two or more first contact members, each of the terminal blocks including a cage connected to one of the conductive members, the cage having an opening that corresponds with an opening of the terminal block, and a pressor member within the cage; and the body further comprises an additional adjustable positioning member for each of the terminal blocks, the additional adjustable positioning members extending through the body from the top surface thereof and bearing on the pressor members to force the pressor members downwardly.

3. The connector of claim 2, wherein each cage is formed on an end of each conductive member.

4. The connector of claim 3, wherein each cage is four-sided and has an opening that coincides with an opening of the terminal block.

5. The connector of claim 2, wherein each cage is adapted to receive a wire such that the pressor member makes electrical contact and drives the wire against the walls of the cage.

6. The connector of claim 1, wherein:

the second side further comprises a second notch in the top portion of the body, the second notch extending inwardly from an edge thereof, opposite and aligned with the first notch of the first side, a second slot extending inwardly from the edge of the second side, aligned with and below the second notch, and two or more second contact members spaced from one another within the second slot, the second contact members being connected to respective opposite ends of the conductive members; and the body further comprises an additional adjustable positioning member for each of the second contact members, the additional adjustable positioning members extending through the body from the top surface thereof and bearing on the second contact members to force the second contact members downwardly.

7. The connector of claim 6, wherein the first and second slots are adapted to receive strips of linear lighting such that the first and second contact members, respectively, make electrical contact with the strips of linear lighting.

8. The connector of claim 6, wherein the first contact members are trapezoidal in front elevation, wider at their tops than their bottoms.

9. The connector of claim 6, wherein the second contact members are trapezoidal in front elevation, wider at their tops than their bottoms.

10. The connector of claim 1, wherein the body is made of a nonconductive material.

11. The connector of claim 1, wherein the adjustable positioning members comprise screws.

12. The connector of claim 1, wherein the first contact members are trapezoidal in front elevation, wider at their tops than their bottoms.

13. A connector comprising:

a first side with a slot configured to accommodate a strip of linear lighting, the slot having at least two electrical contacts, spaced from one another, that are adapted to be driven down into engagement with the strip of linear lighting by a first set of adjustable positioning members that bear on surfaces of the at least two electrical contacts; and a second side with at least two terminal blocks in electrical communication with the at least two electrical contacts, each terminal block including a conductive cage and a pressor member within the cage, the pressor member adapted to be driven down into engagement by second adjustable positioning members that bear on the pressor member.

14. The connector of claim 13, wherein the slot comprises a recessed notch, the recessed notch extending inwardly from an edge of an upper portion thereof.

* * * * *